US005392528A

United States Patent [19]

McDougall

[11] Patent Number: 5,392,528

[45] Date of Patent: Feb. 28, 1995

[54] HAIR DRYERS

[75] Inventor: Gregory J. McDougall, Kowloon, Hong Kong

[73] Assignee: ISIS International Inc., Hong Kong, Hong Kong

[21] Appl. No.: 77,551

[22] Filed: Jun. 14, 1993

[51] Int. Cl.[6] ..... A45D 20/00

[52] U.S. Cl. ..... 34/97; 34/96; 239/101; 392/383

[58] Field of Search ..... 34/96, 97, 98, 3, 243 R, 34/283; 392/379, 380, 383, 384; 239/101, 102.1, 223, 224, 222.17, 382, 383, 463, 214

[56] References Cited

U.S. PATENT DOCUMENTS

| | | | |
|---|---|---|---|
| 4,019,260 | 4/1977 | Levy et al. | 34/97 |
| 4,097,722 | 6/1978 | Soler et al. | 34/97 |
| 4,132,360 | 1/1979 | Lee, Jr. | 34/97 |
| 4,232,454 | 11/1980 | Springer | 34/97 |
| 4,295,283 | 10/1981 | Tomaro | 34/97 |
| 4,525,623 | 6/1985 | Di Silva | 34/96 |
| 4,602,146 | 7/1986 | Barns et al. | 34/97 |
| 5,054,211 | 10/1991 | Shulman | 34/97 |
| 5,121,463 | 6/1992 | Yoshihara | 34/97 |
| 5,157,757 | 10/1992 | McDougall | 34/97 |

*Primary Examiner*—Denise L. Gromada
*Attorney, Agent, or Firm*—Browning, Bushman, Anderson & Brookhart

[57] ABSTRACT

An adjustable pulsator for a hair dryer has a rotatable disc 14 with peripheral blades 17. A housing 18 has apertures 26 which are effectively closed by more or the less by protrusions 27 when a ring 19 supporting the protrusions 27 is rotated relative to the housing 18. The more open the apertures, the faster the disc 14 will rotate in use.

6 Claims, 3 Drawing Sheets

HAIR DRYERS

The present invention relates to hair dryers.

The invention relates more particularly to a pulsator for a hair dryer which is driven by a stream of air from a blower and causes the air to be dispersed in a manner to simulate or cause pulses of air to be supplied at an outlet of the blower. It is already known to provide such pulsators, and one such pulsator is described in European application 441752. The pulsator comprises a centrally supported disc which is caused to rotate by the stream of air in a manner to interfere with the stream so that the air delivered to the user is non-laminar to simulate pulses emitting from the hair dryer.

It is an object of the present invention to provide a pulsator for a hair dryer in which the speed of rotation is controllable without significantly interfering with the pattern of the outflowing air and in a manner that is readily adaptable for providing the pulsator as a builtin or detachable component of a hair dryer.

According to the invention there is provided a pulsator for a hair dryer comprising a rotatably mounted generally circular disc which has an open sector to allow air to pass through the disc, a plurality of blades disposed around a peripheral rim of the disc to cause the disc to rotate when air flows past the blades, a housing with a central bearing for supporting the disc and having a number of apertures disposed around an imaginary circle opposite the blades, and a ring member mounted adjacent the housing with a number of protrusions which fit respectively at least partially over the apertures, in which the protrusions of the ring member are arranged to be movable relative to the apertures about the rotational axis of the disc to control the amount of air passing through the apertures so as to alter the speed of rotation of the disc in use.

The central open sector may extend over substantially half of the disc.

The disc may be rotationally counter-balanced in a manner to compensate for missing material of the open sector.

The pulsator may include an adapter which is fixed to the housing and is releasably attachable to an air outlet of a hair dryer.

Pulsators according to the invention will now be described by way of example with reference to the accompanying drawings in which.

Figure 1:
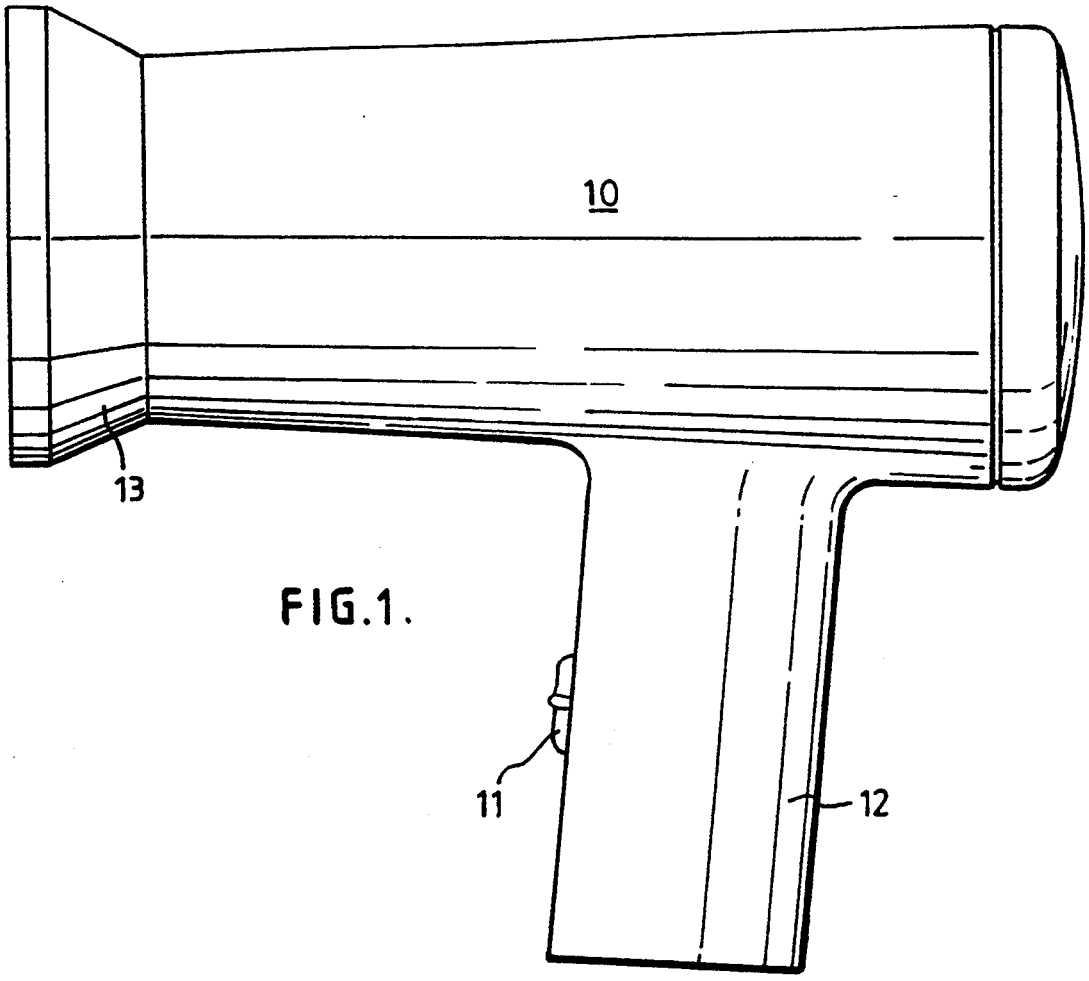
FIG. 1 shows a side elevation of a hair dryer having a pulsator attached.

With reference to the drawings in FIG. 1, the hair dryer 10 is a generally conventional hand holdable dryer incorporating a fan, electrical heating coils and controls and other components which are not shown and well understood in the art. An on-off button 11 is provided on a handle 12. The pulsator 13 releasably fits on an air outlet of the dryer 10. The pulsator 13 may alternatively be permanently attached to the dryer or "builtin" to the air outlet.

Figure 2:
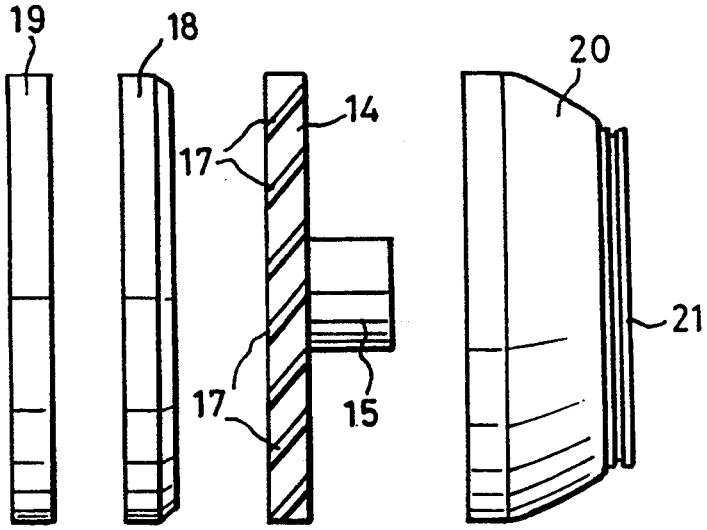
FIG. 2 shows an exploded side elevation of components of the pulsator.

In FIG. 2, the pulsator 13 comprises a circular disc 14 mounted on a central hub 15 and having a plurality of blades 17 mounted on its periphery. An axle (not shown) fits in the hub to support the disc 14.

A housing 18 fits over the blades 17 in the assembled pulsator, and a ring 19 which fits over the housing 18 is rotationally slidable around the housing 18. An adapter 20 is fixed to a rear chamfered edge of the housing 18 and releasably attachable to the outlet of the dryer by springs (not shown) which grip a slot in a rear collar 21.

Figure 3:
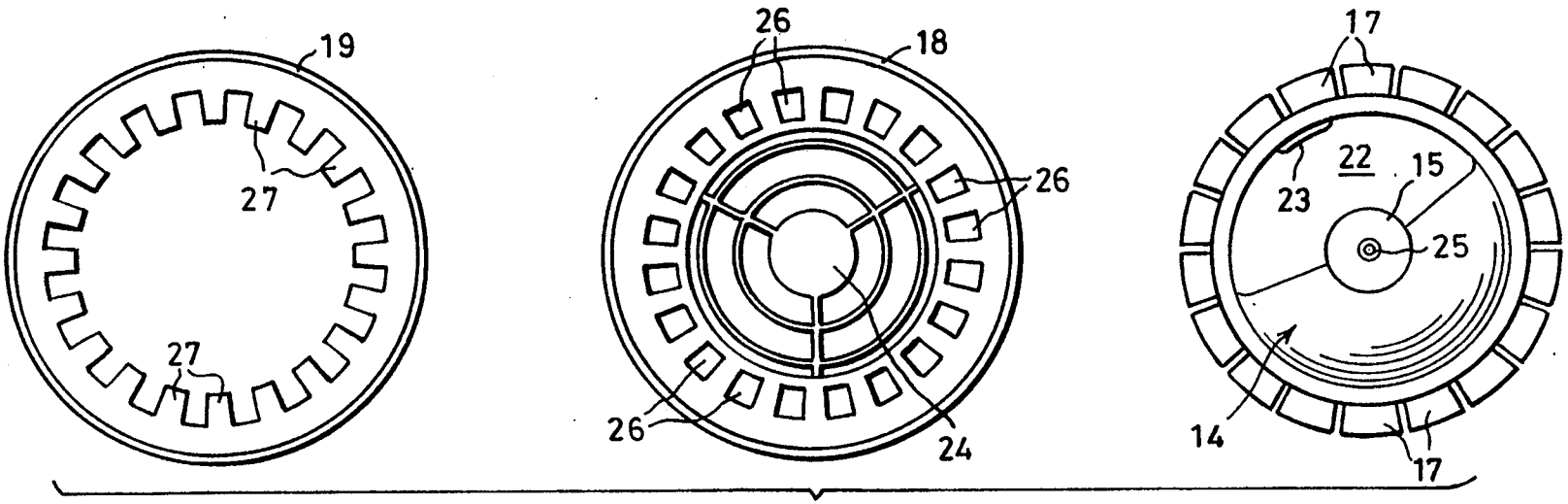
FIG. 3 shows end views of some of the components of FIG. 2.

In FIG. 3, the disc 14 has a open sector 22 comprising substantially half the disc 14. A small weight 23 acts to rotationally balance the disc 14. The housing 18 has a central boss 24 in which a bearing is mounted for receiving the axle in the hub 15. A number of apertures 26 are arranged around an imaginary circle and provided in the housing 18 to lie opposite the blades 17 in the assembled pulsator. The ring 19 has a number of protrusions 27 which fit respectively partially over the apertures 26. As the ring 19 is turned relative to the housing 18, the protrusions move to close off the apertures to a greater or lesser extent.

In use, the disc 14 is caused to rotate by air from the blower of the hair dryer passing over the blades 17 and escaping through the apertures 26. When the apertures are fully open, the disc 14 will rotate at its maximum speed; and as the ring 19 is rotatably adjusted to partly close off the apertures to control the amount of air passing through the apertures the speed of the disc 14 will alter accordingly. In this manner, the speed of the disc 14 can be controlled by the user.

In the described embodiment, the general pattern of air flow out of the dryer is not significantly altered. The air will of course be pulsed by the action of the spinning opening 22 as before. Pulsing is more noticeable or significant at slower disc speeds; but the user may often require at some times only slight pulsing, and therefore the higher disc speeds are then required.

The described pulsator in providing control or adjustment by relative rotation of the ring 19 enables a speed control which is simple to provide and easily adaptable for use with current designs of hair dryer. The arrangement of blades only at the periphery of the disc 14 makes the disc design relatively simple and straightforward and allows for a large open sector, sector 22, to be provided which is highly preferable for enhancing the pulsing effect.

The terms "aperture" and "protrusion" have been used in the specification, and are used in the claims. It is intended that: such terms are interchangeable as is reasonable because the apertures can be formed in effect by, say, the separations between the pairs of protrusions, and the protrusions can be formed in effect by solid parts bounding each aperture. Indeed, relatively movable overlapping protrusions or overlapping apertures may be used effectively to control the flow of air over the blades as required. Further, the air flow upstream of the blades may be adjusted to control the speed of the disc, in which case the apertures and relatively movable protrusions are positioned between the disc and the blower of the hair dryer.

Figure 4:
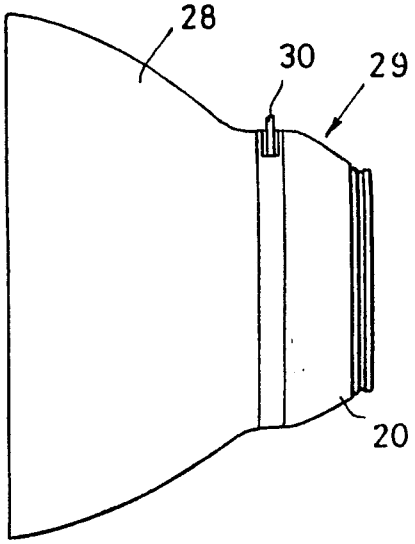
FIG. 4 is a side elevation of an air diffuser for a hair dryer with a built-in pulsator.

In FIG. 4, an air diffuser 28 has a pulsator 29 fitted at its inlet. The pulsator 29 is generally the same as described with reference to FIGS. 2 and 3, and may be releasably attached or permanently fixed to the air diffuser itself. The adapter 20 provides an attachment of the air diffuser to the dryer 10. The disc 19 (not shown) has a finger 30 attached thereto which protrudes to enable the user to rotate the disc 19 sufficiently to control the air flow past the blades as required.

As the pulsator may be provided as an accessory or attachment, and/or as part of a diffuser, for use with a number of different hair dryers which have different fixed or adjustable blower speeds, it is an important feature that the effective speed of the disc, and therefore, the pulsing effect, can be readily altered by the user in the manner described.

It will be appreciated that the apertures 26 can be arranged "upstream" of the blades 17, as well as downstream as described. This means that the flow of air from the fan towards the blades is controlled by adjusting the rotational position of the ring 19. Also, where in the described arrangement one ring 19 is provided two or more rings could be provided, with protrusions 27 rotationally movable to close off or partially close off the apertures together. This allows in a practical way for the apertures 26 to be generally wider in a circumferential direction. Such a pulsator is shown in FIG. 5 where like parts have been like numbered.

Figure 5:
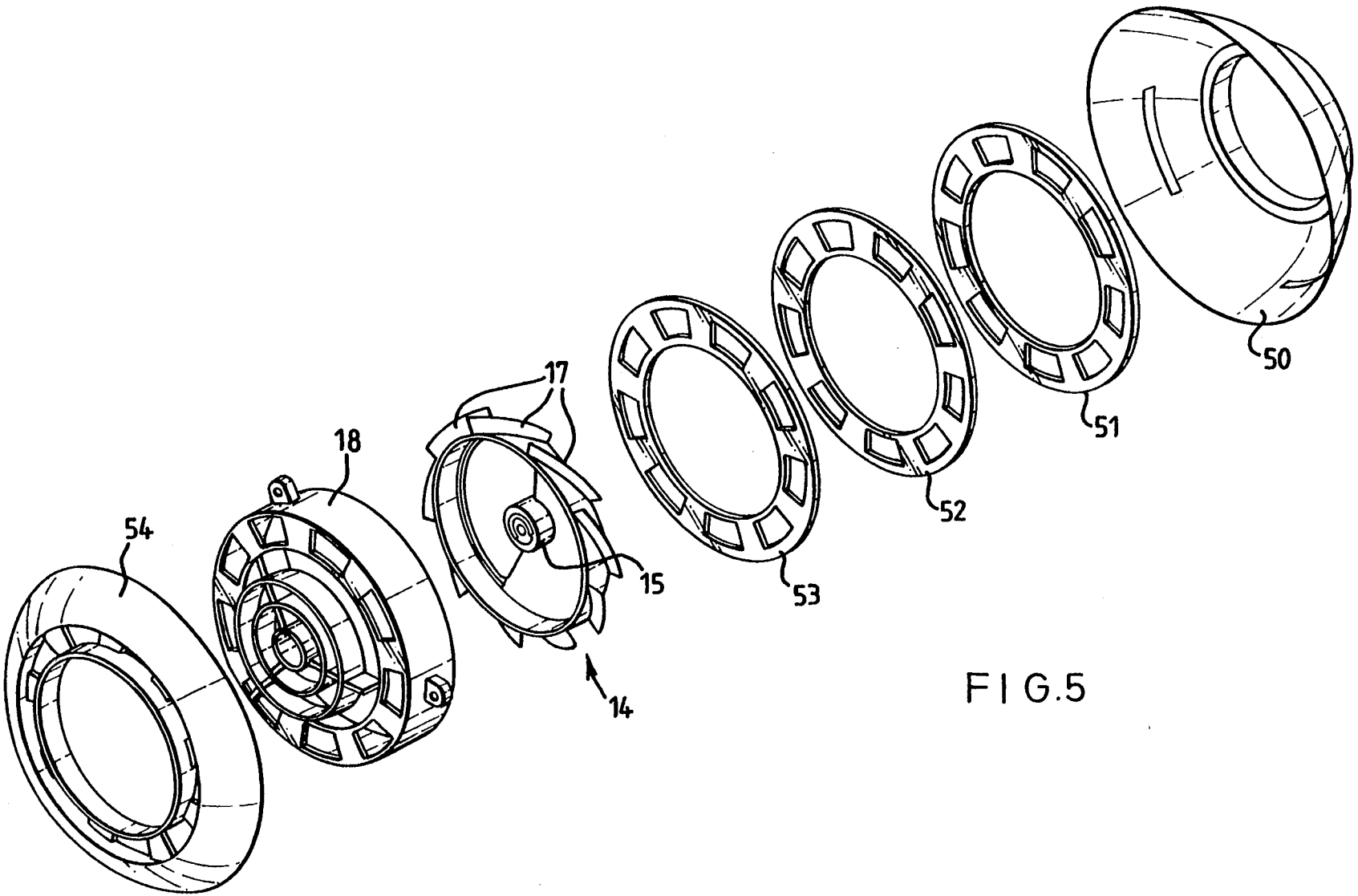
FIG. 5 is an exploded isometric view of another pulsator.

In FIG. 5, the pulsator has an outer housing 50 into which fits a first apertured disc 51 which is rotationally fixed to the housing 50. A second and third apertured disc 52 and 53 are held in the housing 50 and free to rotate with respect to the housing. An inner housing 18 has a central boss 24 which supports a disc 14 with peripheral blades (7) as described earlier. The housing 18 is held in a cover 54 which clips to and against the housing 50 and is rotatable with respect to the housing 50. A rear surface of the inner housing 18 has lugs (not shown) and the surfaces of the discs 52 and 53 have inter-engaging parts on their surfaces arranged to cooperate with the lugs and each other to rotate the discs.

In use, when the cover 54 is rotated with respect to the housing 50, the apertures in the discs 50, 51 and 52 can be wholly aligned or only partially aligned as required. Thus, when the apertures of the discs are all in line, a maximum flow of air is directed towards the blades 17. As the cover 54 is rotated, it causes the discs 51 and 52 to rotate and effectively close off the apertures in the disc 50 to cause little or a minimum amount of air to pass the blades 14 and so control the rotational speed of the disc 14 in the manner described earlier.

The advantage of having two discs, discs 51 and 52, instead of only one disc, is that the apertures in the disc 50 in particular can be generally much greater in the circumferential direction than otherwise the circumferential direction and still be effectively closed off as required for the slowest speed of the disc. However, and as described in FIGS. 2 and 3, the pulsator could be provided with only one rotational disc, either disc 51 or disc 52.

I claim:

1. A pulsator for a hair dryer comprising a rotatably mounted generally circular disc which has an open sector to allow air to pass through the disc, a plurality of blades disposed around a peripheral rim of the disc to cause the disc to rotate when air flows past the blades, a housing with a central bearing for supporting the disc and having a number of apertures disposed around an imaginary circle opposite the blades, and a ring member mounted adjacent the housing with a number of protrusions which fit respectively at least partially over the apertures, in which the protrusions of the ring member are arranged to be movable relative to the apertures about the rotational axis of the disc to control the amount of air passing through the apertures so as to alter the speed of rotation of the disc in use.

2. A pulsator according to claim 1, in which a central open sector extends over substantially half of the disc.

3. A pulsator according to claim 1, in which the disc is rotationally counter-balanced in a manner to compensate for missing material of the open sector of the disc.

4. A pulsator according to claim 1, including an adapter which is fixed to the housing and is releasably attachable to the outlet of a hair dryer.

5. An air diffuser for a hair dryer, said air diffuser having an inlet and a pulsator according to claim 1 adjacent said inlet.

6. A hair dryer having mounted thereto a pulsator according to claim 1.

* * * * *

UNITED STATES PATENT AND TRADEMARK OFFICE

CERTIFICATE OF CORRECTION

PATENT NO. : 5,392,528
DATED : February 28, 1995
INVENTOR(S) : Gregory J. McDougall It is certified that error appears in the above-indentified patent and that said Letters Patent is hereby corrected as shown below:

In column 1, line 20, delete "builtin" and insert therefor --built-in--.

In column 1, line 68, delete "'builtin'" and insert therefor --"built-in"--.

In column 3, line 15, insert a comma after "provided".

Signed and Sealed this

Ninth Day of May, 1995

*Attest:*

*Attesting Officer*

BRUCE LEHMAN

*Commissioner of Patents and Trademarks*